US009700084B2

(12) United States Patent
Luxi et al.

(10) Patent No.: US 9,700,084 B2
(45) **Date of Patent: *Jul. 11, 2017**

(54) BACKLESS AND POSSIBLY STRAPLESS BRASSIERE WITH A REINFORCING PLATE

(71) Applicant: Hanes Operations Europe SAS, Rueil Malmaison (FR)

(72) Inventors: Fabio Luxi, Rueil Malmaison (FR); Alan Cucknell, Cambridge (GB)

(73) Assignee: Hanes Operations Europe SAS, Rueil Malmaison (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/415,563

(22) Filed: Jan. 25, 2017

(65) Prior Publication Data

US 2017/0127733 A1 May 11, 2017

Related U.S. Application Data

(63) Continuation of application No. 15/137,755, filed on Apr. 25, 2016, now Pat. No. 9,560,886, which is a (Continued)

(30) Foreign Application Priority Data

Mar. 15, 2012 (FR) ..... 12 52363

(51) Int. Cl.
*A41C 3/00* (2006.01)
*A41C 3/10* (2006.01)
(Continued)

(52) U.S. Cl.
CPC ..... *A41C 3/10* (2013.01); *A41C 3/0078* (2013.01); *A41C 3/06* (2013.01); *A41C 3/124* (2013.01); *A41C 5/005* (2013.01)

(58) Field of Classification Search
CPC .... A41C 3/00; A41C 3/06; A41C 3/10; A41C 3/12; A41C 3/14; A41C 3/142;
(Continued)

(56) References Cited

U.S. PATENT DOCUMENTS 2,061,238 A 11/1936 Klein
2,428,572 A 10/1947 Lobel
(Continued)

FOREIGN PATENT DOCUMENTS

CN 2860133 1/2007
DE 202006015176 12/2006
(Continued)

OTHER PUBLICATIONS

International Search Report issued Oct. 15, 2013 re: PCT/FR2013/050519.
(Continued)

*Primary Examiner* — Gloria Hale
(74) *Attorney, Agent, or Firm* — Fish & Richardson P.C.

(57) ABSTRACT

A brassiere, such as a backless and optionally strapless brassiere, includes a basque to accommodate the torso of a user, a pair of concave cups coupled to a portion of the basque, and a pair of reinforcement plates coupled to the concave cups. The reinforcement plates help support a wearer's chest in each one of the cups. Each of the reinforcement plates include fingers extending from an outside of a respective bra cup toward a center of the respective bra cup. The fingers include a first finger extending under the area of the respective cup.

16 Claims, 5 Drawing Sheets

Related U.S. Application Data continuation of application No. 14/385,415, filed as application No. PCT/FR2013/050519 on Mar. 12, 2013, now Pat. No. 9,345,273.

(51) Int. Cl.

| | |
|---|---|
| ***A41C 3/12*** | (2006.01) |
| ***A41C 3/06*** | (2006.01) |
| ***A41C 5/00*** | (2006.01) |

(58) Field of Classification Search

CPC ..... A41C 3/128; A41C 3/124; A41C 3/122; A41C 3/0078; A41C 1/18; A41C 1/00; A41C 1/12; A41C 1/14

USPC ..... 450/54–57, 41–45

See application file for complete search history.

(56) References Cited

U.S. PATENT DOCUMENTS

| | | | | |
|---|---|---|---|---|
| 2,440,426 | A | 4/1948 | Barlow et al. | |
| 2,992,646 | A | 7/1961 | Weinberg | |
| 2,994,325 | A | 8/1961 | Geissman | |
| 3,021,844 | A | 2/1962 | Flagg | |
| 3,196,450 | A | 7/1965 | Haistead | |
| 3,351,951 | A | 11/1967 | Perry | |
| 3,446,213 | A | 5/1969 | goldman | |
| 3,556,107 | A | 1/1971 | Brumfield | |
| 8,152,593 | B2 | 4/2012 | Barton et al. | |
| 8,864,549 | B2 | 10/2014 | McKeen | |
| 9,345,273 | B2 * | 5/2016 | Luxi | A41C 3/0007 |
| 9,560,886 | B2 * | 2/2017 | Luxi | A41C 3/0007 450/1 |
| 2006/0223415 | A1 | 10/2006 | Watrin | |
| 2007/0155283 | A1 | 7/2007 | McQueer | |
| 2009/0197509 | A1 | 8/2009 | Fildan et al. | |
| 2014/0213145 | A1 | 7/2014 | McKeen | |
| 2015/0044941 | A1 * | 2/2015 | Luxi | A41C 3/0007 450/41 |
| 2016/0235131 | A1 * | 8/2016 | Luxi | A41C 3/0007 |

FOREIGN PATENT DOCUMENTS

| | | |
|---|---|---|
| FR | 2924901 | 6/2009 |
| GB | 655178 | 7/1951 |
| JP | 5192236 | 8/1976 |
| JP | 2006104639 | 4/2006 |

OTHER PUBLICATIONS

Notification of the First Office Action, Chinese Application No. 2013800144355, Jul. 1, 2015, 5 pages.

Federal Intellectual Property Service, Federal Institute of Industrial Property, Request for Substantive Examination, Russian Application No. 2014140686/12, Mar. 17, 2017, 8 pages.

* cited by examiner

BACKLESS AND POSSIBLY STRAPLESS BRASSIERE WITH A REINFORCING PLATE

CROSS-REFERENCE TO RELATED APPLICATION(S)

This application is a continuation of and claims the benefit of priority to U.S. patent application Ser. No. 15/137,755, filed on Apr. 25, 2016, which is a continuation of U.S. patent application Ser. No. 14/385,415, filed on Sep. 15, 2014 and issued as U.S. Pat. No. 9,345,273 on May 24, 2016, which claims priority under 35 U.S.C. §371 to International Application Serial No. PCT/FR2013/050519, filed on Mar. 12, 2013, which claims priority to French International Application Serial No. FR 12/52363, filed on Mar. 15, 2012, the entire contents of which are hereby incorporated by reference.

TECHNICAL FIELD

The present invention relates to a backless brassiere and which may be with or without straps, or with removable straps.

BACKGROUND

Strapless brassieres are known and must overcome the absence of the support usually provided by the straps by a particular device. Patent FR 2 924 901 on behalf of the Applicant has made known a brassiere including a sandwich of thermoformed layers defining two cups and comprising a reinforcing element incorporated in the sandwich in the form of a plate made of a rigid material in one direction coextensive with the plate and elastically flexible in a transverse direction. The plate comprises flexible fingers disposed under and in the cup. This brassiere is highly satisfactory but has a back.

However, at least on some occasions, for example when the users wear dresses with low backs, they require having a brassiere that is not only strapless but also backless. The majority of the numerous brassieres proposed for this purpose are adhesive, over all or part of the surface in contact with the chest of the user, which may be unpleasant to wear and upon removing the brassiere. There have been proposed without success in a distant past brassieres incorporating an elastic rigid underwire forming a spring around the torso, for example in document U.S. Pat. No. 2,428,572 of 1945, but it has not been known since then to manufacture and commercialize a brassiere comfortable enough to be worn several hours straight without discomfort and which had enough hold.

Document U.S. Pat. No. 3,556,107, makes known a brassiere having a bottom torso underwire and a high lateral underwire in two portions, however, these two elements are not structurally connected to each other; although both are inserted in a same textile band forming the base of the brassiere, they are disjoined and their mechanical action is independent since the efforts exerting on one of the elements cannot be transmitted to another of the elements. The hold of such a brassiere over the chest has not proven satisfactory.

It is the same for the brassiere known by document U.S. Pat. No. 2,440,426; it may comprise one single underwire formed by a wire having a torso underwire and lateral portions connected to the torso underwire, but these lateral portions are bottom portions, at the same level as the front basque, which do not allow a good equilibrium of the chest.

BRIEF SUMMARY

The purpose of the invention is to propose a backless and possibly strapless brassiere, which still ensures a good comfortable and durable hold, of the chest.

The purpose of the invention is met thanks to a backless brassiere with a basque and cups, including at least one internal textile layer, one external textile layer, as well as at least one torso underwire and cup reinforcements disposed between the two textile layers, the torso underwire being an arched rigid elastic underwire forming a spring shaped to partially envelop the torso of the user, the reinforcements being shaped to help support the chest in each one of the cups of the brassiere, the torso underwire including a substantially low horizontal main portion corresponding to the front of the torso and to the basque portion of the brassiere, characterized in that the low main portion connects on the sides of the torso to two high lateral portions. It is understood that reference is made to a structural connection between these portions.

It has been realized that this constitution and this particular shape of the underwire where the contact of the underwire with the torso is made higher laterally than on the front of the brassiere, allows a very good hold of the chest, with a rise effect of the breasts and prevents the chest from falling forward.

The invention is further characterized in that it exhibits, individually or in combination, the following advantageous features.

- The brassiere is strapless or it includes a removable strap system.
- The torso underwire is constituted of a rigid elastic wire, for example metallic or in a rigid plastic material.
- The rigid elastic wire of the underwire has a substantially round section, possibly with profiled shapes (grooves, ribs) lengthwise. The diameter of the metallic wire for example ranges between 2 and 4 mm. Advantageously still, the wire may have a flattened section, rectangular or elongated oval, for example of 1 mm thick.
- The torso underwire comprises on the front middle of its main portion a concave area in the middle of the global convex shape of the main portion. The central portion of the low main portion may also rise upward between the breasts, with a curve connecting the low portions on the side; this shape will still be considered as a substantially horizontal low portion, as it actually is in the spaced apart portions in between the breasts.
- The high lateral portions are formed of one single piece in the rigid elastic wire forming the main portion.
- The high lateral portions are added to the rigid elastic wire forming the main portion.
- The high lateral portions are part of a substantially inverted U-shaped arch. They may comprise a substantially horizontal portion, or a rounded portion, so that the inverted U is a square U or a round U, or even another less regular shape. The high lateral portions are joined to the main low portion by rising portions, which may be substantially vertical, or more or less tilted. Most importantly is that there is sufficient height difference, of a few centimeters, between the bottom portion and the top portions, for creating a cantilever effect. The high lateral portions advantageously comprise a maximum height on the front of the lateral portion, then decrease in height by continuing rearward on the sides. The lateral portions comprise elements for fixing the cup reinforcement.

The underwire comprises tabs for securing textile layers or for securing different portions together.

The underwire is enclosed in a textile sleeve.

The cup reinforcement is in form of a plate made of a rigid material in one direction coextensive with the plate and elastically flexible in a transverse direction. By this, is meant that the plate, due to its constitutive material and its geometry, is rigid and non-deformable in a direction tangential to its surface, but it is elastically deformable, incidentally in modest proportions, in a transverse direction. In other words, it is possible to bend a portion of the plate and the latter tends to spontaneously regain its undeformed position.

Said plate comprises fingers originating from a lateral region disposed substantially on the outside of a respective cup and cooperating with the high lateral portion of the underwire. Given the geometry and the material, these fingers are relatively flexible in a direction perpendicular to the surface of the plate.

Said plate comprises a horizontal finger extending substantially in a horizontal arch under the cup, and several fingers extending in the cup.

The fingers of the plate or at least some of them are shaped conform to the concave shape of the basque and to that of the cup.

The lateral portion of the reinforcing plate may be lightened by one or more recesses.

The reinforcing plate comprises a plurality of holes for securing the textile layers and/or the underwire.

The elastic underwire cooperates with the reinforcing plates to hold the latter by partially pressing them against the torso: in fact only the plate lateral region opposite to the fingers is pressed against the side of the torso, whereas the flexible fingers, are not pressed and hold the chest and the cups.

The shaping of the fingers may be immediately obtained by a molding of the plate, for example by injection, or by thermoforming (under pressure and with heat).

The entire plate is shaped according to an inwardly concave shape.

The material of the reinforcing plate is for example a polycarbonate, preferably in a thickness of 0.5 to 1.2 mm, for example 1 mm thick. This material is satisfactory both from the point of view of its elastic rigidity and its moldability. In addition, this material is light and is easily worked (cut out). The fingers have a width which may vary according to the models but is for example in the range of 1 to 2 cm over most part of their extension, which is of several centimeters, for example between 2 and 12 cm. The PET (polyethylene terephthalate), the ABS (acrylonitrile butadiene styrene) may also be used. Other rigid thermoplastic materials, and thermoforming well, may be chosen from the group comprising the high impact polystyrene, the high density polyethylene, some polyamides and some polypropylenes. The basic material of the plate may be covered with textile or nonwoven layers bonded together, possibly with foam interposed, for example polyurethane foam.

The textile layers may be associated over all or part of their surface with comfort layers, in particular foam layers, such as a polyurethane foam.

The brassiere may be manufactured in form of a multilayer complex composed of the stratified textile layers, foam layers, and glue layers, the torso underwire and the reinforcing plate being disposed in a thermoforming mold between two layers of the complex, preferably between two foam layers.

The brassiere may also be made by tailoring, the textile layers being sewn therebetween and to the underwire and the reinforcing plates.

The brassiere according to the invention may be a smart brassiere, a swimsuit brassiere, or be integrated in a garment element.

BRIEF DESCRIPTION OF THE DRAWINGS

Other features and advantages of the invention will become apparent from the following description of a particular embodiment example. Reference will be made to the accompanying drawings in which.

DETAILED DESCRIPTION

Figure 7:
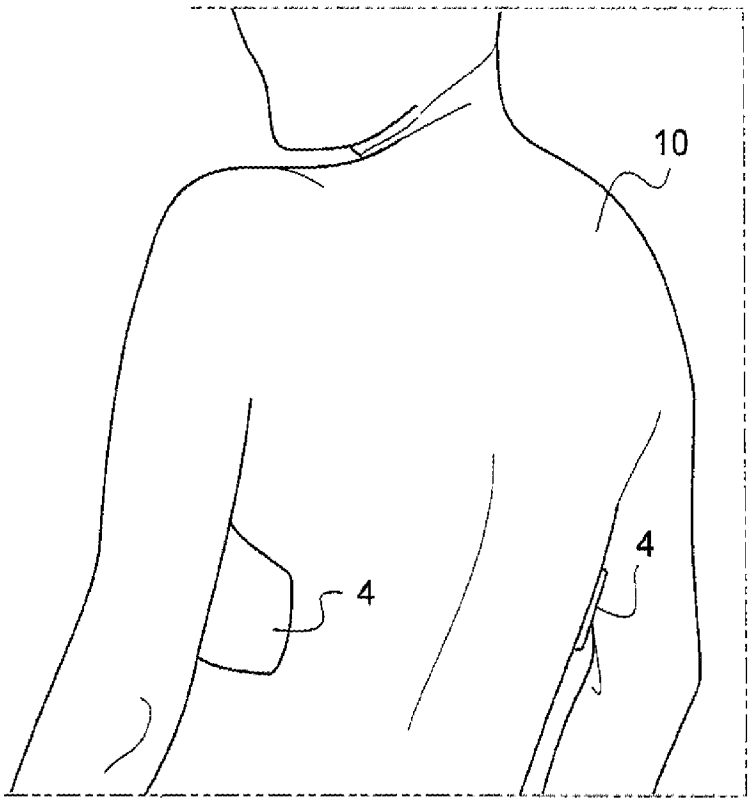
FIGS. 6 and 7 are two perspective views of the brassiere of the invention over the torso of a user, in respective view of three-quarters front and three-quarters back.

The brassiere 1 of the invention comprises (cf. FIGS. 6 and 7) two cups 2 of a highly concave shape on the internal side (substantially hemispherical), each surrounded towards the bottom of a basque 3 portion and on the side of a lateral portion 4. The two cups 2 espouse the breasts 11 of the user 10. The basque 3 follows the periphery of the torso of the user, at the front and the side. As it is seen, the represented brassiere has neither straps nor back, but the invention might apply to a brassiere provided with straps and in particular with a removable strap system. The lateral portions 4 extend on the sides of the torso of the user and return very slightly in the back of the user, as shown in FIG. 7.

Figure 1:
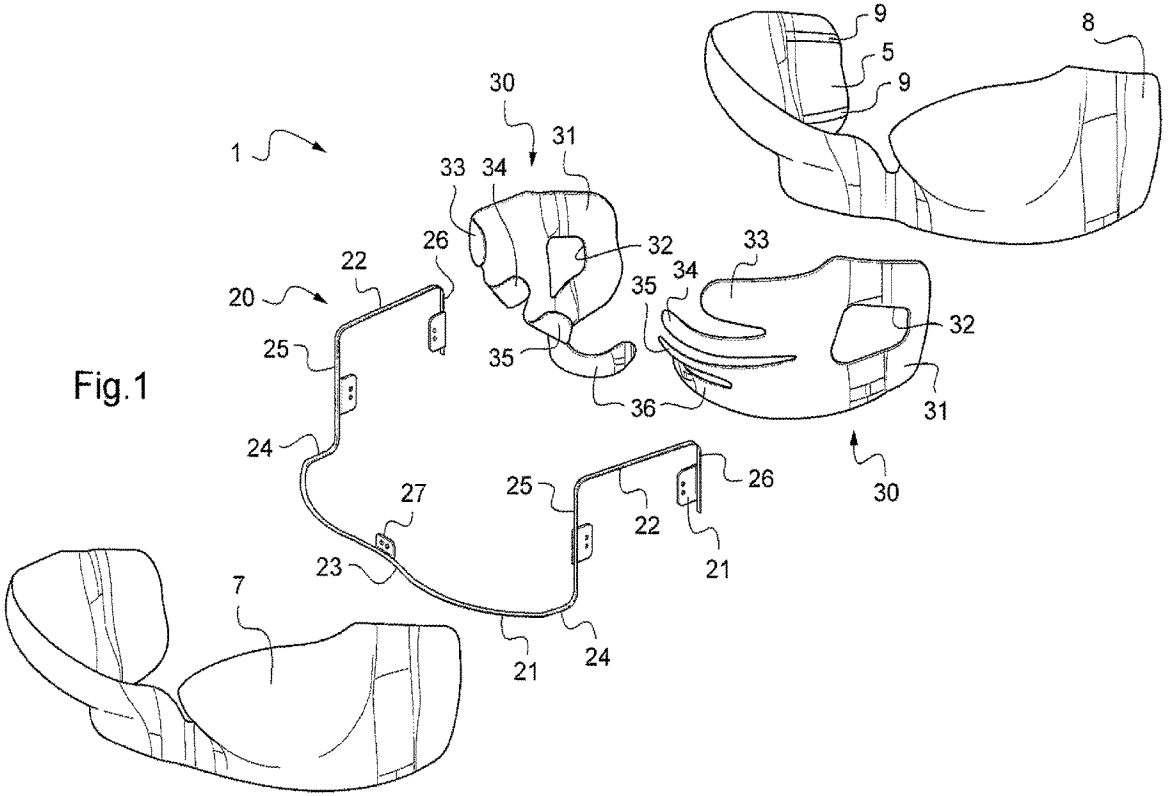
FIG. 1 is an exploded perspective view of a brassiere in accordance with the invention.

FIG. 1 shows the basic constitution of the brassiere 1. It comprises an external textile layer 7, a torso underwire 20, two reinforcing plates 30 and an internal textile layer 8.

The torso underwire 20 is made in a rigid metallic wire having some elasticity. It comprises a low horizontal main portion 21 at the front, surrounded by two high horizontal lateral portions 22 directed rearward and located at several centimeters from the low portion, for example between 3 and 10 cm. The front portion 21 is globally concave on the internal side, with the exception of a curvature inversion in its central portion 23, concave on the external side, for better following the epigastric fossa. The front portion 21 is connected to the high lateral portions 22 on the one hand by a short horizontal rearward return 24 and a vertical branch 25 (this branch may possibly join the low portion with curved portions, or be slightly tilted). The high horizontal portion 22 continues rearward by a vertical return 26 directed towards the bottom. The assembly 25, 22, 26 forms an inverted square U-shaped arch which will be placed in the side 4 of the brassiere below the armpits and will cooperate with the cup reinforcing plates as it will be seen later on. In FIG. 1 it is represented tabs 27 placed at different locations in order to facilitate the securing the underwire to the other elements of the brassiere 1, namely the textile layers 7, 8 and the reinforcing plates 30. In this embodiment, all the underwire is made with one single wire.

Figure 8:
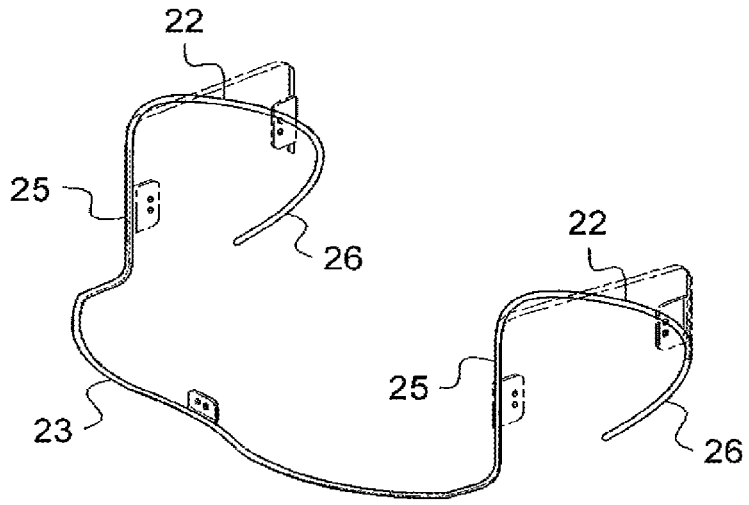
FIGS. 8, 9, and 10 represent three alternatives of the shape of the underwire of FIG. 1.
Figure 9:
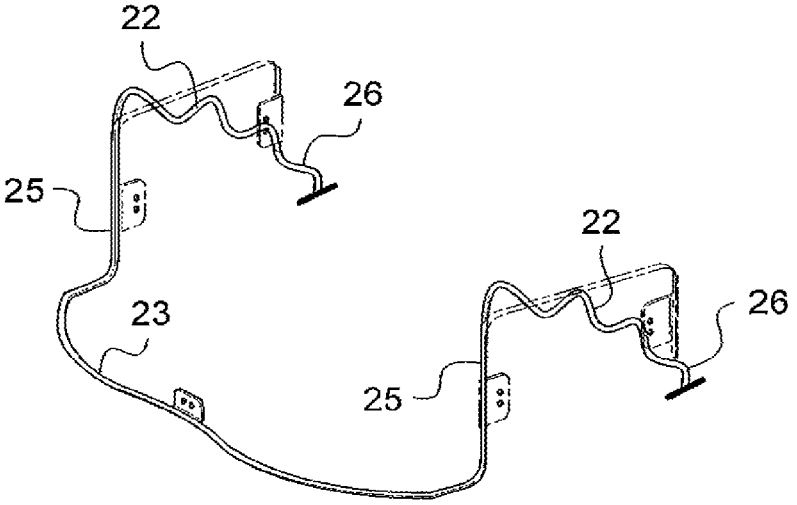
Figure 10:
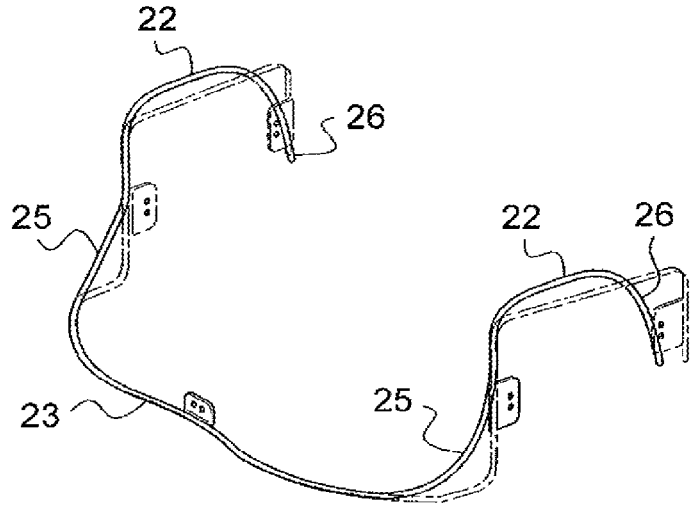

FIGS. 8 to 10 represent alternatives of shape of the high lateral portion 22 of the underwire 20 (the underwire of FIG. 1 is represented in dashes to allow the comparison). In FIG. 8, after the vertical rising portion 25, the high lateral portion 22 is rather rounded and blends in the rear portion 26 which drops towards the bottom, so as to form a rounded and slightly looped arch. In FIG. 9, after the vertical rising portion 25, the high lateral portion 22 runs in a zigzag and drops toward the rear portion 26 with which it coincides. In FIG. 10, the rising portion 25 is tilted because it starts farther from the central portion 23 and curvingly joins the high lateral portion 22, itself rounded and blending in the rear portion 26 which drops towards the bottom.

Figure 3:
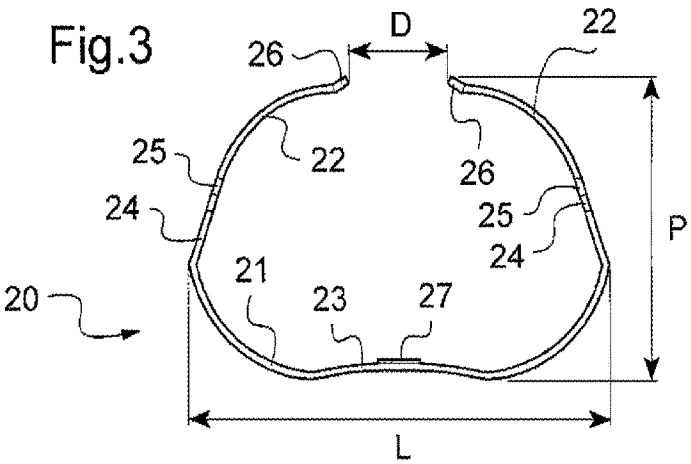
FIG. 3 is a top view of the underwire of FIG. 2.
Figure 2:
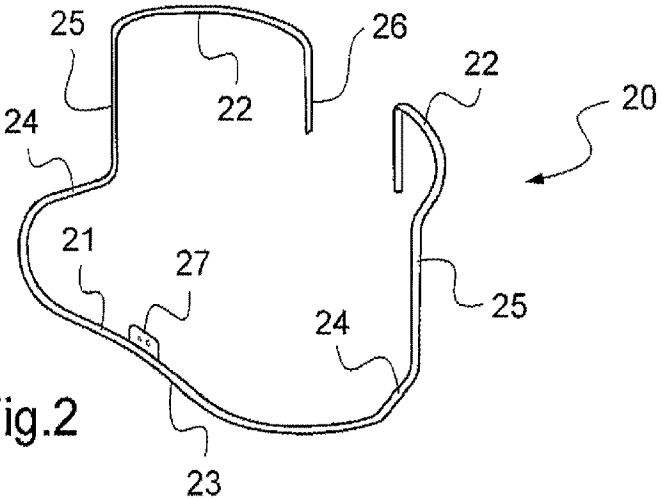
FIG. 2 is a perspective view of an alternative shape of the underwire of the brassiere of the invention.

FIGS. 2 and 3 show an alternative of underwire 20 represented in its at rest state, that is to say corresponding to the brassiere when it is not worn. The same elements as those which have just been described are found, but it is realized that the lateral portions 24, 25, 22, 26 strongly converge towards each other, due essentially to the curvature (with the concavity towards the inside) given to the horizontal branches 22 during manufacture and to the angle formed between the front portion 21 and the rear return 24. In the represented alternative, the overall width L of the brassiere at rest is for example of 230 mm, its depth P of 173 mm and the distance between the ends 26 of the lateral portions only 60 mm. Thanks to the elasticity of the underwire, this distance D may be elastically enlarged when the user passes the brassiere around her torso, and the underwire then takes a position closer to what is represented in FIG. 1.

Figure 6:
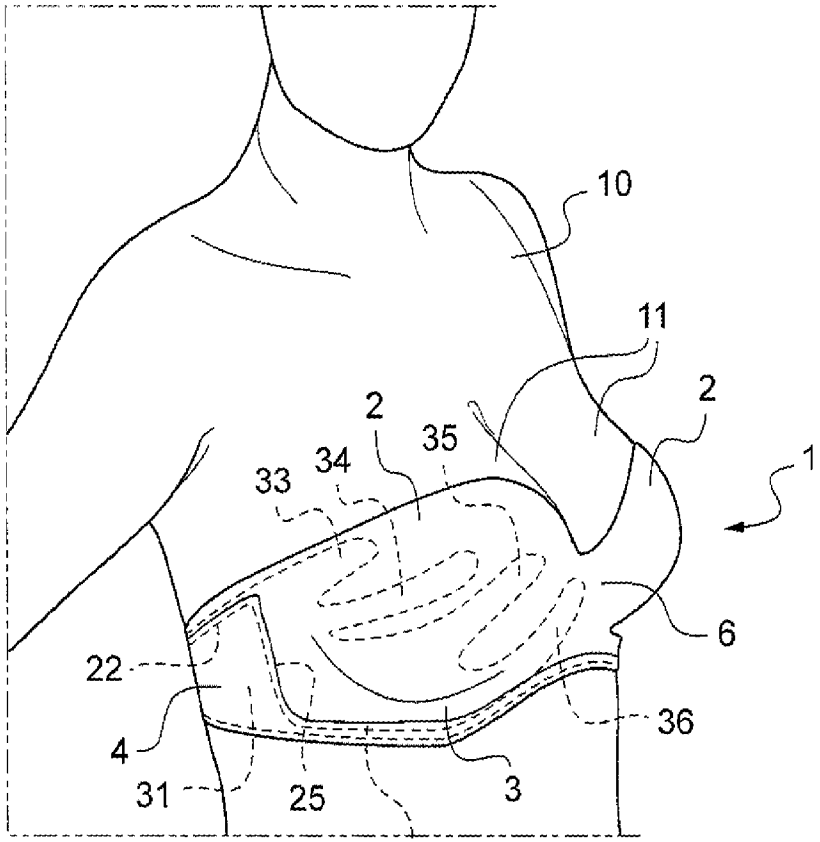

Returning to FIG. 1, it is seen that each reinforcing plate 30 is on one hand shaped globally concave inside to form the volume of the cups. Each plate 30 comprises a lateral portion 31, possibly lightened by one or several recesses 32, which extends substantially horizontally, toward the center of the brassiere, by substantially horizontal, untied and flexible fingers 33, 34, 35 and 36, of which the total length increases from the shortest, the upper finger 33, to the longest, the lower finger 36. Due to their shape, the fingers are substantially elastically flexible and may be spaced apart in a horizontal direction in front or behind the cup 2; however, the fingers practically do not move in a vertical direction and participate well in supporting the chest. The lateral portion 31 is substantially rigid compared to the fingers, due to its more solid and gathered shape. FIG. 6 shows in dashes the position of the fingers inside the brassiere 1. The lower finger 36 is advantageously located in the basque 3 just below the cup 2 or at its beginning and its length allows it to go practically up to the portion between the cups 6 of the brassiere. The upper finger 33 hardly penetrates into the cup 2, while the intermediary fingers 34 and 35 penetrate gradually more, the finger 34 substantially up to the center of the cup and the finger 35 beyond the center, inwards, below the middle of the cup. These fingers ensure a good hold of the chest of which the efforts are thus transmitted on the lateral portions 31 of the plates 30. The lateral portions 31 of the plates 30 are retained in place between the torso of the user on the one hand and the lateral portions of the torso underwire on the other hand: it has been represented in FIG. 3 in a double continuous line/dashes the position of the underwire with its front branch 21 and, on the sides of the torso front, the vertical branch 31 and the horizontal branch 22. The arch shape of the lateral portions 25, 22, 26 of the underwire allows pressing against the side of the torso the lateral portion 31 of the reinforcing plate of which the flexible fingers 33-36 support the chest and give a shape to the cups 2; the weight of the chest is thus in part hung at the high point of contact with the torso, located rather high under the arms of the user, and in part pressing on the torso front by the bottom of the underwire.

Figure 4:
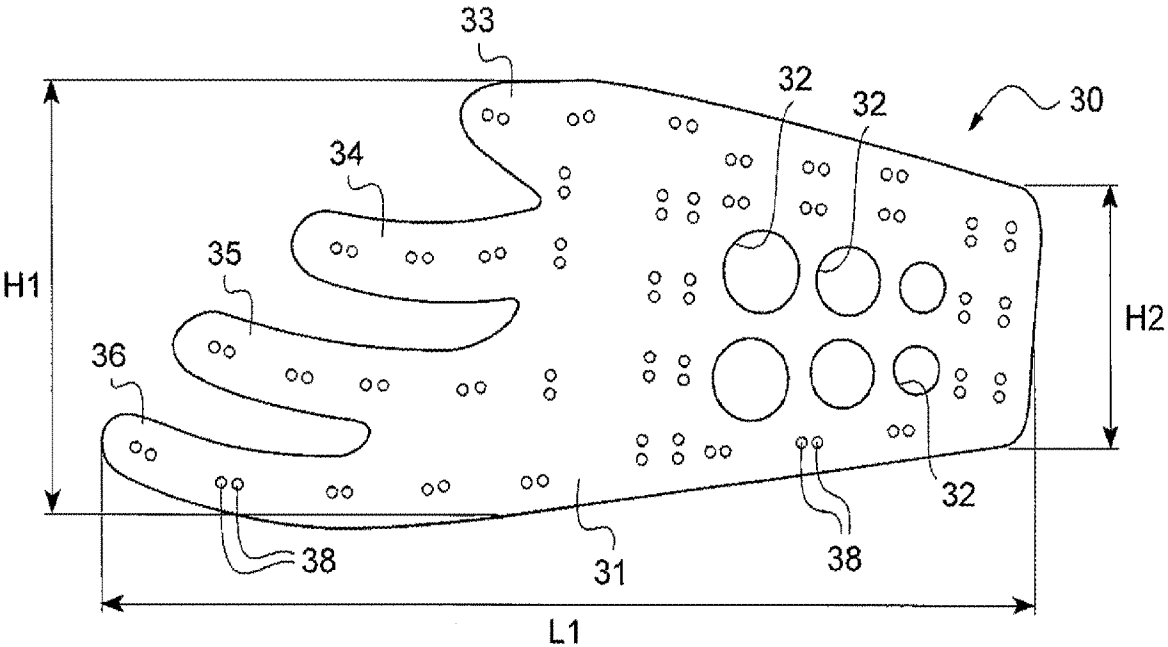
FIG. 4 is a flat view of an alternative of reinforcing plate of a brassiere of the invention.

As shown in FIG. 4, the plate includes multiple small holes, or even here pairs of holes 38, in the lateral portion 31 as well as in the fingers 33-34. These holes may be used to attach by sewing the internal and external textile layers 7, 8 to the plate at diverse determined locations, during the tailoring of the brassiere. Moreover, these holes also contribute to lighten the brassiere and increase the breathability thereof. In an embodiment, the flat length L1 of the plate 30 is 280 mm, its overall height H1 is of 120 mm and its height H2 at the rear of the lateral portion 31 is of 73 mm.

The reinforcing plate 30 is made of polycarbonate in the range of 0.8 mm to 1.2 mm, for example 1 mm, thickness. If it must be glued to layers, in particular layers of foam (not represented), its adhesion to the neighboring layers may be reinforced by roughening its surface, even though the small holes 38 also allow the passage of the bridges of glue.

The textile layers 7,8 are for example a knitted textile of less than one millimeter thickness, in particular a jersey mixed with polyamide and elastane giving a mesh liable to extend in all directions of the plane of the textile surface. They may be associated with layers of foam, for example polyurethane foam layers, of more or less thickness according to the locations where they are provided and according to the possible compression that they may undergo during a possible thermoforming step during the manufacture of the brassiere.

Figure 5:
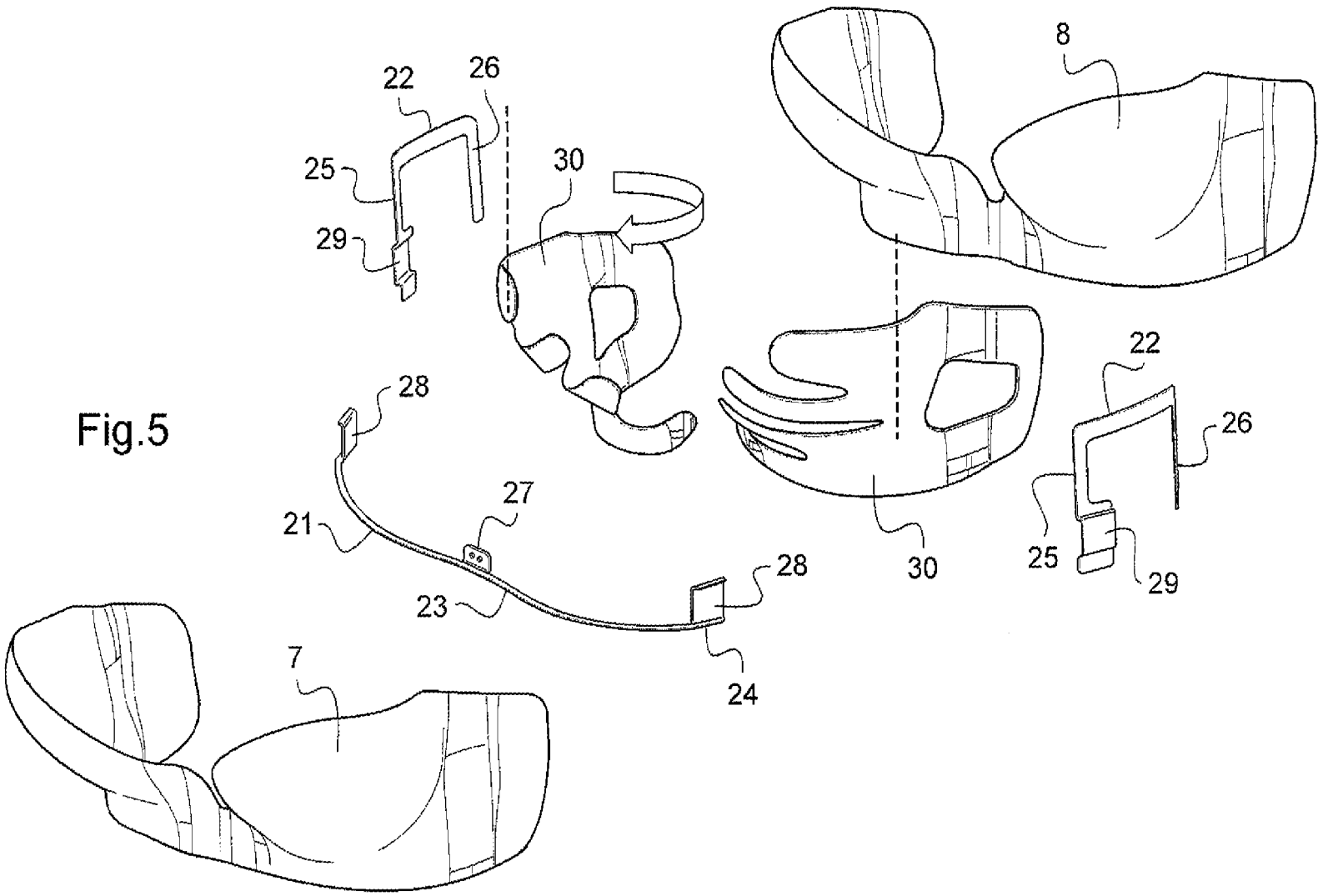
FIG. 5 is an alternative of FIG. 1, showing the manufacturing in two portions of the torso underwire of the brassiere of the invention.

The embodiment of FIG. 5 differs from that of FIG. 1 in that the underwire is constituted of two added portions: on the one hand, the front portion 21 with its two returns 24 and on the other hand the lateral portions in the inverted U-shaped arch 25, 22, 26, which can be assembled to each other thanks to connecting parts 28, 29 provided respectively on the returns 24 and the vertical branches 25. This constitution in two separate portions which may be assembled to each other may be better adapted to some modes of manufacturing and assembling of the brassiere.

Advantageously, it may be provided on the inner portion 5 of the lateral portions 4 of the brassiere lines or dots 9 of a slip-resistant product, for example a silicone gel, for promoting the hold in position of the brassiere.

Fitting tests have been performed with the brassieres of the invention and have proven quite conclusive: the users were able to wear them for several hours (5 hours) without feeling discomfort and were able during this time to practice diverse light physical exercise such as walking and simple dances without substantial displacement of the brassiere.

The invention claimed is:

1. A brassiere, comprising:

a basque configured to accommodate a torso of a user;

a pair of concave cups coupled to a portion of the basque; and a pair of reinforcement plates coupled to the concave cups and configured to help support the user's breasts, each of the reinforcement plates comprising a plurality of fingers extending from an outside of a respective bra cup of the concave cups toward a center of the respective bra cup, the plurality of fingers comprising a first finger extending under an area of the respective bra cup.

2. The brassiere of claim 1, wherein each of the plurality of fingers has a concave shape to accommodate the concave shape of the respective bra cup.

3. The brassiere of claim 1, wherein each of the plurality of fingers is substantially rigid in a direction coextensive with the reinforcement plate, and elastically flexible in a transverse direction.

4. The brassiere of claim 3, wherein the coextensive direction is substantially tangential to a surface of the reinforcement plate, and the transverse direction is substantially perpendicular to the surface of the reinforcement plate.

5. The brassiere of claim 1, wherein at least two fingers in the plurality of fingers are arranged in a parallel configuration.

6. The brassiere of claim 1, wherein the plurality of fingers are arranged in a parallel configuration distributed in a vertical direction of the brassiere, and wherein the first finger comprises a lowest finger of the configuration.

7. The brassiere of claim 6, wherein the length of each of the plurality of fingers is less than an adjacent lower finger, such that the first finger comprises the longest finger of the plurality of fingers and the upper most finger comprises the shortest finger of the plurality of fingers.

8. The brassiere of claim 1, wherein each of the reinforcement plates comprises a pattern of apertures distributed along the plurality of fingers.

9. The brassiere of claim 8, further comprising a textile layer covering the basque and the cups, the textile layer directly attached to the reinforcement plates at one or more of the apertures.

10. The brassiere of claim 1, wherein the first finger is positioned to extend along a length of the basque.

11. The brassiere of claim 1, wherein each of the reinforcement plates comprises a molded polycarbonate structure.

12. The brassiere of claim 1, further comprising a torso underwire supporting the reinforcement plates, the torso underwire comprising an arched rigid underwire forming an elastic spring configured to partially envelop the torso of the user.

13. The brassiere of claim 12, wherein the torso underwire comprises:

a horizontal main portion corresponding to a front of the torso and to the basque of the brassiere;

a pair of lateral portions corresponding to sides of the torso; and a pair of structural connections coupling the horizontal main portion to the lateral portions.

14. The brassiere of claim 13, wherein the lateral portions of the torso underwire are formed contiguously with the structural connections and the horizontal main portion of the torso underwire.

15. The brassiere of claim 13, wherein the structural connection are configured, such that, when the brassiere is worn by the user, contact of the torso underwire with the torso is made higher laterally than on a front of the brassiere.

16. The brassiere of claim 1, wherein an assembly comprising the basque, the cups, and the reinforcement plates is both backless and strapless.

* * * * *